US010741119B2

(12) United States Patent
Zeng et al.

(10) Patent No.: US 10,741,119 B2
(45) **Date of Patent: *Aug. 11, 2020**

(54) DRIVING METHOD AND DRIVING SYSTEM FOR REDUCING RESIDUAL IMAGE OF AMOLED DISPLAY

(71) Applicant: Shenzhen China Star Optoelectronics Technology Co., Ltd., Shenzhen (CN)

(72) Inventors: Yuchao Zeng, Shenzhen (CN); Tai Jiun Hwang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 699 days.

This patent is subject to a terminal disclaimer.

(21) Appl. No.: 15/327,308

(22) PCT Filed: Dec. 21, 2016

(86) PCT No.: PCT/CN2016/111339

§ 371 (c)(1),
(2) Date: Jan. 18, 2017

(87) PCT Pub. No.: WO2018/028110

PCT Pub. Date: Feb. 15, 2018

(65) Prior Publication Data

US 2019/0392753 A1 Dec. 26, 2019

(30) Foreign Application Priority Data

Aug. 9, 2016 (CN) ..... 2016 1 0649241

(51) Int. Cl.
*G09G 3/20* (2006.01)
*G09G 3/3225* (2016.01)

(52) U.S. Cl.
CPC ... *G09G 3/3225* (2013.01); *G09G 2320/0233* (2013.01); *G09G 2320/0257* (2013.01)

(58) Field of Classification Search
CPC ..... G09G 2320/043; G09G 2330/021; G09G 2360/16; G09G 2360/18; G09G 3/20; G09G 3/3208; G09G 5/10
See application file for complete search history.

(56) References Cited

U.S. PATENT DOCUMENTS

2002/0057234 A1* 5/2002 Ishizuka ..... G09G 3/3208 345/77
2013/0307926 A1* 11/2013 Aoyama ..... H04N 13/106 348/43

FOREIGN PATENT DOCUMENTS

CN 1641727 A 7/2005
CN 102308331 A 1/2012
(Continued)

OTHER PUBLICATIONS

Chinese Office Action for related Chinese Application No. 201610649241 dated Feb. 24 2018; (5 pages).
(Continued)

*Primary Examiner* — Insa Sadio

(57) ABSTRACT

Disclosed are a driving method and a driving system for reducing a residual image of AMOLED display. The driving method includes steps of: determining whether an image to be displayed is a static image; performing hierarchical segmentation on the static image if a determination result is yes; regulating an output brightness proportional coefficient of each pixel based on a hierarchical segmentation result; and outputting brightness of each pixel according to a corresponding output brightness proportional coefficient. The driving method can significantly reduce generation of a residual image when a static image is displayed.

8 Claims, 4 Drawing Sheets

(56) References Cited

FOREIGN PATENT DOCUMENTS

| | | | |
|---|---|---|---|
| CN | 102402939 | A | 4/2012 |
| CN | 102903348 | A | 1/2013 |
| CN | 104318893 | A | 1/2015 |
| CN | 104766561 | A | 7/2015 |
| CN | 104978722 | A | 10/2015 |
| CN | 105096829 | A | 11/2015 |
| CN | 105225634 | A | 1/2016 |
| CN | 105741768 | A | 7/2016 |
| CN | 106023894 | A | 10/2016 |
| JP | 2016052013 | A | 4/2016 |
| WO | 2018028110 | A1 | 2/2018 |

OTHER PUBLICATIONS

International Search Report and Written Opinion for related International Application No. PCT/CN2016/111339; dated Apr. 21, 2017; (17 pages).
Chinese Office Action for related Chinese Application No. 201610649241.8; dated Jul. 24, 2018; (6 pages).

* cited by examiner

DRIVING METHOD AND DRIVING SYSTEM FOR REDUCING RESIDUAL IMAGE OF AMOLED DISPLAY

CROSS-REFERENCE TO RELATED APPLICATIONS

This application claims the priority of Chinese patent application CN201610649241.8, entitled "Driving Method and Driving System for Reducing Residual Image of AMOLED Display" and filed on Aug. 9, 2016, the entirety of which is incorporated herein by reference.

FIELD OF THE INVENTION

The present disclosure relates to the technical field of OLED display, and in particular, to a driving method and a driving system for reducing a residual image of AMOLED display.

BACKGROUND OF THE INVENTION

OLED (Organic Light-Emitting Diode) display technology is a new display technology which has been developed rapidly in recent years. In the OLED display technology, based on self-luminous properties of the organic light-emitting diode, organic semiconductor materials and light-emitting materials are enabled to emit light and display through carrier injection and recombination under driving of an electric field.

The drive mode of OLED display is divided into a PMOLED (Passive Matrix) drive and an AMOLED (Active Matrix) drive. In the AMOLED display, it is necessary to provide each pixel with a low temperature poly silicon thin film transistor (LTPS TFT) having a switch function to apply a drive voltage to the organic light-emitting diode. Therefore, AMOLED will show a residual image when performing image switching after displaying a static high contrast image for a period of time.

As shown in FIG. 1, in a static high contrast image, there is a high brightness region, while in the next frame image after the image is switched, as shown by the lower image in FIG. 1, there is no longer a high brightness region. Since a pixel having high brightness is applied with a higher pixel voltage, the aging of the drive transistor of the pixel having high brightness is faster than those of other pixels having low brightness. Therefore, the next frame image actually displayed after switching is as shown by the residual image (i.e., the right one as shown in FIG. 1). For a high contrast image, since the image brightness difference is obvious, the drive transistor aging difference is more obvious, and thereby the high contrast image is more likely to leave a residual image.

The main method for eliminating the residual image of AMOLED display in the prior art is to multiply each pixel brightness in the static image by a uniform proportional coefficient for output so as to alleviate the aging phenomenon of the transistor by reducing the drive voltage and reduce the residual image. However, as to a high contrast static image, after the overall brightness of the image is reduced, the pixel brightness difference between its high contrast region and other regions is still large, and the image hierarchy is relatively obvious, which affects the effect of OLED display.

The present disclosure provides a solution to the above problem.

SUMMARY OF THE INVENTION

One of the technical problems to be solved by the present disclosure is to provide a method for reducing a residual image of a high contrast static image to improve its display effect.

In order to solve the above technical problem, the present disclosure first provides a driving method for reducing a residual image of AMOLED display. The method comprises steps of: determining whether an image to be displayed is a static image; performing hierarchical segmentation on the static image if a determination result is yes; regulating an output brightness proportional coefficient of each pixel based on a hierarchical segmentation result; and outputting brightness of each pixel according to a corresponding output brightness proportional coefficient.

Preferably, the step of performing hierarchical segmentation on the static image comprises: determining a hierarchical point brightness of the hierarchical segmentation; traversing each pixel in the static image, and classifying the pixel to a hierarchy closest to the hierarchical point brightness; calculating new hierarchical point brightness based on classified hierarchy; and repeating a process of traversing and classifying each pixel, and repeating a process of calculating new hierarchical point brightness until the hierarchical point brightness no longer changes.

Preferably, the step of classifying the pixel to a hierarchy closest to the hierarchical point brightness comprises: obtaining a pixel eigenvalue of each pixel; calculating a difference between the pixel eigenvalue of a pixel and the hierarchical point brightness; and classifying the pixel to a hierarchy corresponding to a minimum absolute value of the difference.

Preferably, the pixel eigenvalue comprises a maximum value of gray scale values of sub-pixels of the pixel or a brightness parameter obtained by calculation based on the gray scale values of the sub-pixels of the pixel.

Preferably, the step of regulating an output brightness proportional coefficient of each pixel based on a hierarchical segmentation result comprises: as to pixels with brightness belonging to different hierarchies, reducing brightness of a pixel belonging to a high hierarchy with a small output brightness proportional coefficient, while reducing brightness of a pixel belonging to a low hierarchy with a large output brightness proportional coefficient; and as to pixels with brightness belonging to a same hierarchy, reducing brightness of a pixel having high brightness with a small output brightness proportional coefficient, while reducing brightness of a pixel having low brightness with a large output brightness proportional coefficient.

Preferably, the step of regulating an output brightness proportional coefficient of each pixel based on a hierarchical segmentation result comprises: performing statistics on hierarchical point brightness of each hierarchy and a pixel area of each hierarchy; determining a minimum output brightness proportional coefficient of each hierarchy based on the hierarchical point brightness of the hierarchy and the pixel area of the hierarchy; and determining an output brightness proportional coefficient of each pixel based on the minimum output brightness proportional coefficient of each hierarchy, the hierarchical point brightness of each hierarchy and brightness of the pixel itself.

Preferably, the minimum output brightness proportional coefficient $M_k$ of each hierarchy is determined based on a following equation:

$$M_k = Y_k * S_k * m_k,$$

wherein $Y_k$ denotes hierarchical point brightness of each hierarchy; $S_k$ denotes a pixel area of each hierarchy; $m_k$ denotes a hierarchy brightness control coefficient; and k denotes a number of hierarchies.

Preferably, when the static image is segmented into three hierarchies, an output brightness proportional coefficient of each pixel is determined based on a following equation:

$$c_1 = 1,\ y \leq \frac{Y_1 + Y_2}{2}$$

$$c_2 = 1 - (1 - M_2)\frac{2y - (Y_1 + Y_2)}{Y_3 - Y_1},\ \frac{Y_1 + Y_2}{2} < y \leq \frac{Y_2 + Y_3}{2}$$

$$c_3 = M_2 - (M_2 - M_3)\frac{y - \frac{Y_2 + Y_3}{2}}{255 - \frac{Y_2 + Y_3}{2}},\ y > \frac{Y_2 + Y_3}{2}$$

wherein $c_1$, $c_2$, $c_3$ respectively denote output brightness proportional coefficients of the hierarchies; $Y_1$, $Y_2$, $Y_3$ respectively denote hierarchical point brightness of each of the hierarchies; $M_1$, $M_2$, $M_3$ respectively denote minimum output brightness proportional coefficients of the hierarchies; and y denotes brightness of each pixel itself.

The present disclosure further provides a driving system for reducing a residual image of AMOLED display. The device comprises: a static image detecting module, configured to determine whether an image to be displayed is a static image; a hierarchical segmentation module, configured to perform hierarchical segmentation on the static image if a determination result is yes; a coefficient regulation module, configured to regulate an output brightness proportional coefficient of each pixel based on a hierarchical segmentation result; and an output module, configured to output brightness of each pixel according to a corresponding output brightness proportional coefficient.

Preferably, the hierarchical segmentation module is configured to: determine a hierarchical point brightness of the hierarchical segmentation; traverse each pixel in the static image, and classify the pixel to a hierarchy closest to the hierarchical point brightness; calculate new hierarchical point brightness based on classified hierarchy; and repeat a process of traversing and classifying each pixel, and repeat a process of calculating new hierarchical point brightness until the hierarchical point brightness no longer changes.

Compared with the prior art, one embodiment or more embodiments in the above solution can have the following advantages or beneficial effects.

Through performing hierarchical segmentation on a static image, and determining an output brightness proportional coefficient of each pixel respectively based on different hierarchies and the brightness of the pixel itself, the generation of the residual image can be significantly reduced when the static image is displayed. Therefore, a high contrast static image is not likely to leave a residual image.

Other advantages, objects and features of the present disclosure will be illustrated in the following description, and to some extent, will be obvious to those skilled in the art based on the study of the following, or can be taught from the practice of the present disclosure. The objects and other advantages of the present disclosure can be achieved and obtained by the structures particularly pointed out in the following description, claims, and accompanying drawings.

BRIEF DESCRIPTION OF THE DRAWINGS

The accompanying drawings are used to provide a further understanding of the technical solution of the present disclosure or the prior art, and constitute a part of the description, wherein the accompanying drawings illustrating the embodiments of the present disclosure are used to explain the technical solution of the present disclosure in conjunction with the embodiments of the present disclosure, but do not constitute a limitation on the technical solution of the present disclosure.

DETAILED DESCRIPTION OF THE EMBODIMENTS

The implementation mode of the present disclosure will be described in detail below with reference to the accompanying drawings and embodiments, by means of which, the implementation process regarding how the present disclosure uses technical means to solve the technical problem and achieve the corresponding technical effect can be fully understood and implemented accordingly. The embodiments of the present disclosure and respective features in the embodiments can be combined with each other under the condition of no conflict, and the formed technical solutions are all within the protection scope of the present disclosure.

Figure 1:
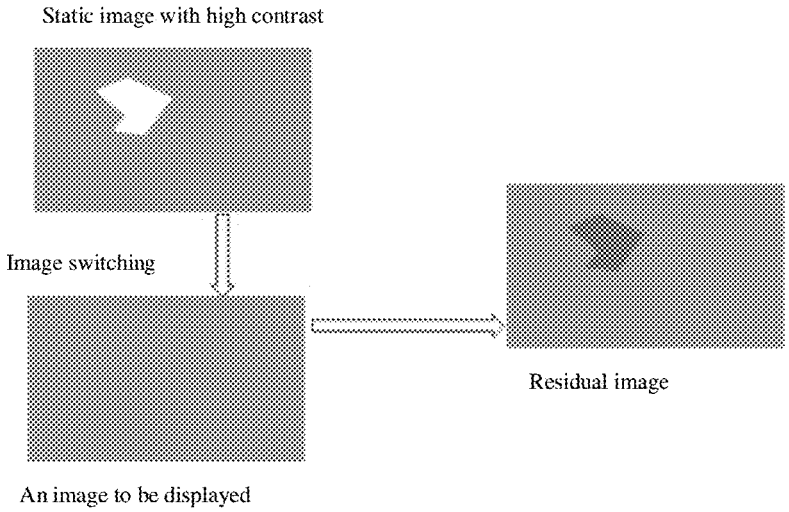
Fig. 1 (Prior Art)
FIG. 1 is a schematic diagram of a generation of a residual image of AMOLED display in the prior art.
Figure 2:
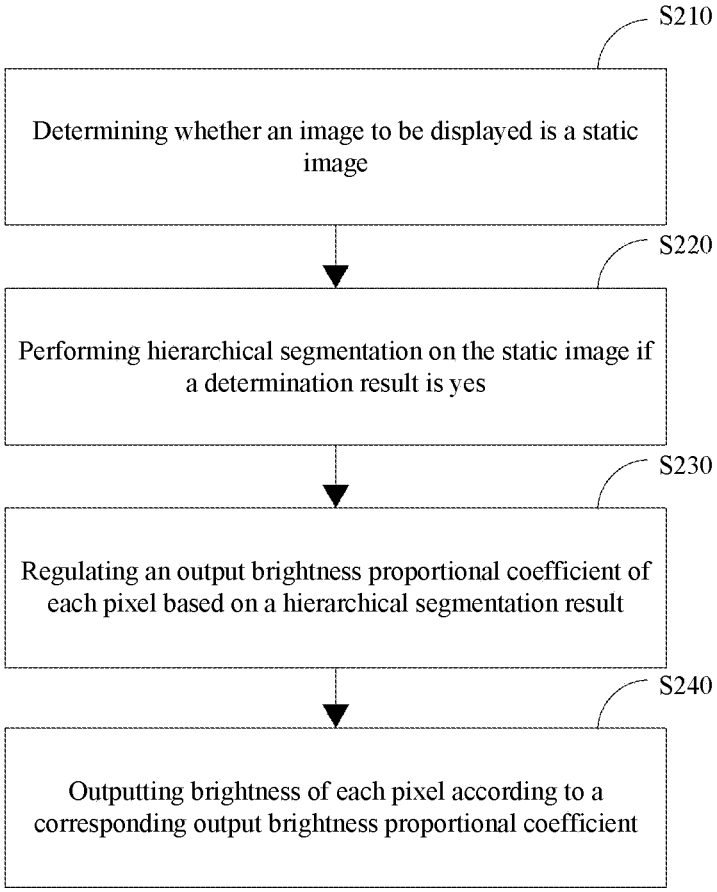
FIG. 2 is a flow chart of a driving method for reducing a residual image of AMOLED display according to one embodiment of the present disclosure.

FIG. 2 is a flow chart of a driving method for reducing a residual image of AMOLED display according to one embodiment of the present disclosure. As shown in FIG. 2, the driving method comprises following steps.

In step S210, whether an image to be displayed is a static image is determined.

In step S220, hierarchical segmentation is performed on the static image if a determination result is yes.

In step S230, an output brightness proportional coefficient of each pixel is regulated based on a hierarchical segmentation result.

In step S240, brightness of each pixel is output according to a corresponding output brightness proportional coefficient.

Specifically, in step S210, it is first determined whether an image to be displayed is a static image. If a determination result is no, it is unnecessary to perform a brightness regulation. Only when a determination result is yes, will step S220 be continued.

Figure 3:
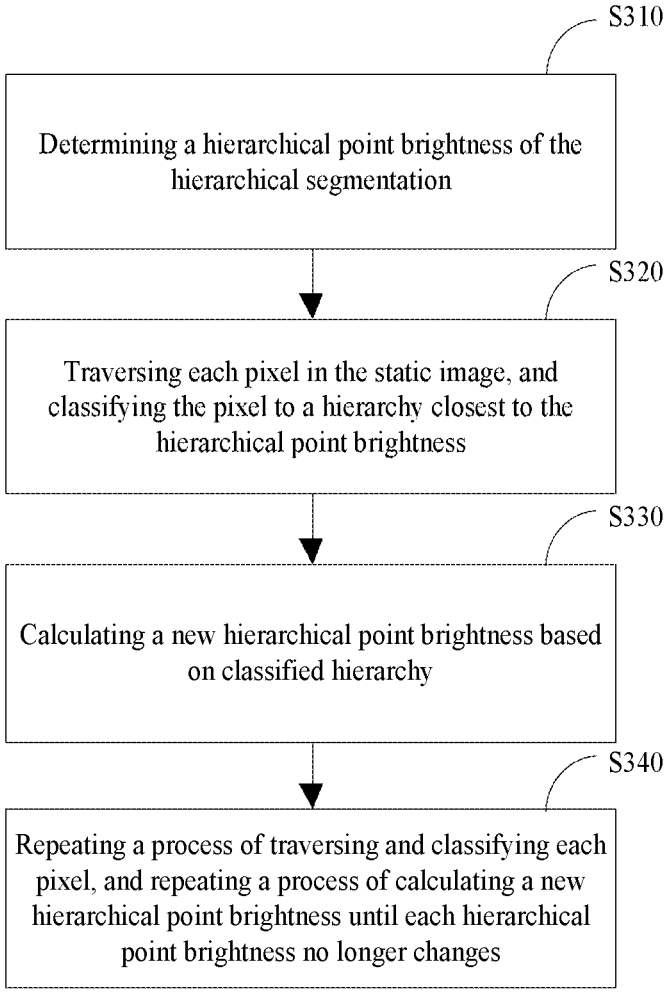
FIG. 3 is a flow chart of a method for performing hierarchical segmentation according to one embodiment of the present disclosure.

In step S220, hierarchical segmentation is performed on the static image to be displayed, which specifically comprises following steps as shown in FIG. 3.

In step S310, a hierarchical point brightness of the hierarchical segmentation is determined.

In step S320, each pixel in the static image is traversed, and the pixel is classified to a hierarchy closest to the hierarchical point brightness.

In step S330, new hierarchical point brightness is calculated based on the classified hierarchy.

In step S340, a process of traversing and classifying each pixel are repeated, and a process of calculating new hierarchical point brightness is repeated until the hierarchical point brightness no longer changes.

In step S310, a number of segmented hierarchies and the hierarchical point brightness of each hierarchy are determined based on a brightness distribution of the static image. For example, one frame of static image to be displayed is segmented into three hierarchies, and the hierarchical point brightness of each hierarchy is respectively determined as follows: a hierarchical point brightness of a first hierarchy is 64, a hierarchical point brightness of a second hierarchy is 80, and a hierarchical point brightness of a third hierarchy is 160.

In step S320, each pixel in the static image is traversed and classified to a hierarchy. Specifically, a pixel eigenvalue of each pixel is first obtained. In one embodiment of the present disclosure, the pixel eigenvalue can be a maximum value of gray scale values of sub-pixels of the pixel or a brightness parameter obtained by calculation based on the gray scale values of the sub-pixels of the pixel.

It should be noted that, the pixel eigenvalue corresponds to the determined hierarchical point brightness. When the pixel eigenvalue is a maximum value of the gray scale values of the sub-pixels, the hierarchical point brightness is also represented by a gray scale value. When the pixel eigenvalue is a brightness parameter obtained by calculation based on the gray scale values of the sub-pixels of the pixel, the hierarchical point brightness is also a corresponding brightness parameter.

Then, a difference between the pixel eigenvalue of a pixel and the hierarchical point brightness is calculated. It can be easily understood that, the difference can represent a degree of proximity between the brightness of the pixel and the hierarchical point brightness.

Further, a minimum absolute value of the difference between the pixel eigenvalue and the hierarchical point brightness is calculated, and the pixel is classified to a hierarchy corresponding to the minimum value. For example, the pixel eigenvalue of a pixel is 70, and then according to the pixel eigenvalue and the hierarchical point brightness, |70-64|, |70-80| and |70-160| are respectively calculated to get the results of 6, 10 and 90, respectively. Therefore, the pixel is classified to the first hierarchy.

Next, in step S330, new hierarchical point brightness is calculated based on the classified hierarchies. Specifically, according to the number of pixels actually contained in each hierarchy and the pixel eigenvalue of each pixel, the value representing the brightness attribute of the hierarchy is obtained. In one embodiment of the present disclosure, a mean value of the pixel eigenvalues of the pixels in one hierarchy is taken as new hierarchical point brightness of the hierarchy.

When the new hierarchical point brightness obtained by calculation is different from the old hierarchical point brightness, the above step S320 and step S330 are repeated until the hierarchical point brightness of each hierarchy no longer changes. In this manner, a stable hierarchical segmentation of the static image to be displayed can be obtained.

Figure 4:
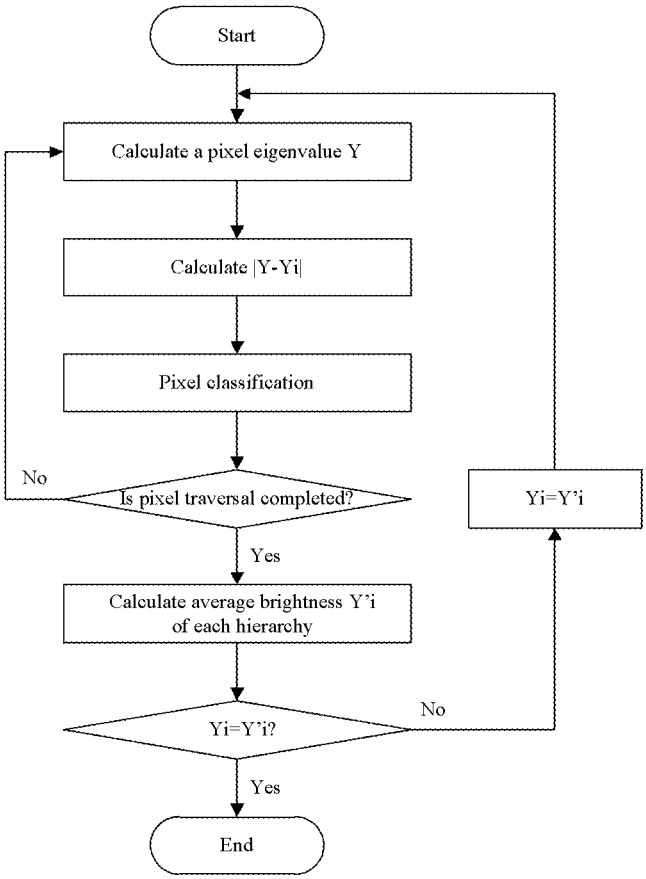
FIG. 4 is a flow chart of a hierarchical segmentation algorithm according to one embodiment of the present disclosure.

A full flow chart of the above-described hierarchical segmentation algorithm is shown in FIG. 4.

After the hierarchical segmentation of the static image is obtained, an output brightness proportional coefficient of the pixels is respectively regulated for each hierarchy. As to pixels with brightness belonging to different hierarchies, brightness of a pixel belonging to a high hierarchy is reduced with a small output brightness proportional coefficient, while brightness of a pixel belonging to a low hierarchy is reduced with a large output brightness proportional coefficient. As to pixels with brightness belonging to a same hierarchy, brightness of a pixel having high brightness is reduced with a small output brightness proportional coefficient, while brightness of a pixel having low brightness is reduced with a large output brightness proportional coefficient. In this way, the brightness difference between the pixel having high brightness and the pixel having low brightness can be reduced, and the contrast between the pixels can be reduced, thereby improving the image display effect.

Figure 5:
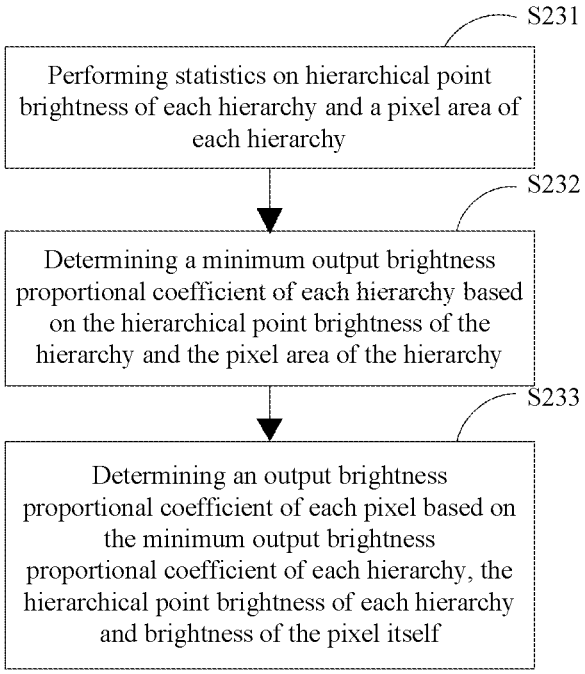
FIG. 5 is a flow chart of a method for determining an output brightness proportional coefficient of each pixel according to one embodiment of the present disclosure.

Specifically, step S230 further comprises following steps as shown in FIG. 5.

In step S231, statistics is performed on hierarchical point brightness of each hierarchy and a pixel area of each hierarchy.

In step S232, a minimum output brightness proportional coefficient of each hierarchy is determined based on the hierarchical point brightness of the hierarchy and the pixel area of the hierarchy.

In step S233, an output brightness proportional coefficient of each pixel is determined based on the minimum output brightness proportional coefficient of each hierarchy, the hierarchical point brightness of each hierarchy and brightness of the pixel itself.

In step S231, it is assumed that a static image to be displayed is segmented into k hierarchies. Statistics of hierarchical point brightness of each hierarchy and a pixel area of each hierarchy is performed. The hierarchical point brightness of a first hierarchy, the hierarchical point brightness of a second hierarchy, . . . , and the hierarchical point brightness of a $k^{th}$ hierarchy are respectively recorded as $Y_1$, $Y_2$, . . . , $Y_k$, and the pixel areas of the first hierarchy, the second hierarchy, . . . , and the $k^{th}$ hierarchy are respectively recorded as $S_1$, $S_2$, . . . , $S_k$.

It should be noted that, the number of pixels contained in each hierarchy can be used to represent the pixel area of a corresponding hierarchy.

In step S232, the minimum output brightness proportional coefficients of respective hierarchies are respectively recorded as $M_1=g_1(S_1, Y_1)$, $M_2=g_2(S_2, Y_2)$, . . . , $M_k=g_k(S_k, Y_k)$.

In one embodiment of the present disclosure, the minimum output brightness proportional coefficient $M_k$ of each hierarchy is determined based on a following equation (1):

$$M_k=Y_k*S_k*m_k \quad (1),$$

wherein $Y_k$ denotes hierarchical point brightness of each hierarchy; $S_k$ denotes a pixel area of each hierarchy; $m_k$ denotes a hierarchy brightness control coefficient; and k denotes a number of hierarchies.

For example, a static image to be displayed is segmented into three hierarchies, and the hierarchical point brightness of each hierarchy is 64, 80, and 160 in sequence. It should be noted that, here, assuming that 64, 80, and 160 are stable hierarchical point brightness determined by repeated calculations and repeated segmentations. The pixel areas of respective hierarchies corresponding to the hierarchical point brightness are 50%, 30% and 20%, respectively.

The hierarchy brightness control coefficient $m_k$ can be determined based on the attributes of the static image to be displayed. For example, in this embodiment, the value of $m_k$ is determined based on the average brightness of the static image to be displayed, and $m_1$, $m_2$ and $m_2$ are 1, 0.8 and 0.7, respectively.

In another embodiment of the present disclosure, when the static image to be displayed is segmented into three hierarchies, an output brightness proportional coefficient of each pixel can be determined based on a following equation (2):

$$c_1 = 1,\ y \leqslant \frac{Y_1 + Y_2}{2} \tag{2}$$

$$c_2 = 1 - (1 - M_2)\frac{2y - (Y_1 + Y_2)}{Y_3 - Y_1},\ \frac{Y_1 + Y_2}{2} < y \leqslant \frac{Y_2 + Y_3}{2}$$

$$c_3 = M_2 - (M_2 - M_3)\frac{y - \frac{Y_2 + Y_3}{2}}{255 - \frac{Y_2 + Y_3}{2}},\ y > \frac{Y_2 + Y_3}{2},$$

wherein $c_1$, $c_2$, $c_3$ respectively denote output brightness proportional coefficients of the hierarchies, and y denotes brightness of each pixel itself.

After the output brightness proportional coefficient of each pixel is obtained, the brightness of each pixel is regulated and output according to the corresponding output brightness proportional coefficient.

In embodiments of the present disclosure, the brightness of the pixels are all regulated based on the original brightness thereof, which is beneficial to the reduction of the driving voltage of the pixels, and the reduction of the brightness of high contrast regions. Meanwhile, the hierarchical changes among the pixels tend to be gentle, and the image display effect can be improved.

Figure 6:
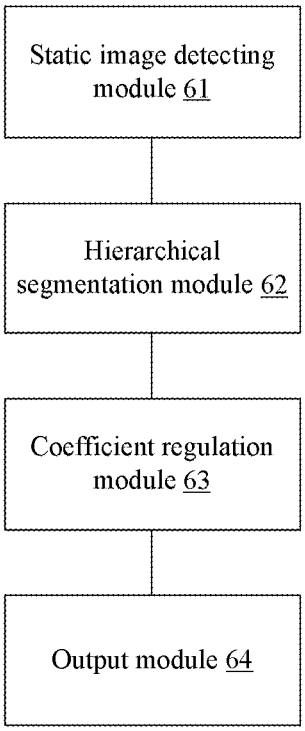
FIG. 6 is a structural diagram of a driving system for reducing a residual image of AMOLED display according to one embodiment of the present disclosure.

In another embodiment of the present disclosure, a driving system for reducing a residual image of AMOLED display is further provided. As shown in FIG. 6, the system comprises:

a static image detecting module 61, configured to determine whether an image to be displayed is a static image;

a hierarchical segmentation module 62, configured to perform hierarchical segmentation on the static image if a determination result is yes;

a coefficient regulation module 63, configured to regulate an output brightness proportional coefficient of each pixel based on a hierarchical segmentation result; and an output module 64, configured to output brightness of each pixel according to a corresponding output brightness proportional coefficient.

The functions of the respective modules can be performed with reference to the corresponding method steps in the previous embodiment, which will not be repeated here.

In the embodiments of the present disclosure, through performing hierarchical segmentation on a static image, and determining an output brightness proportional coefficient of each pixel respectively based on different hierarchies and the brightness of the pixel itself, the generation of the residual image can be significantly reduced when the static image is displayed. Therefore, a high contrast static image is not likely to leave a residual image.

In the embodiments of the present disclosure, the brightness of the high contrast regions in a static image can be reduced, the hierarchical degree of the image can be reduced, and the display effect can be improved.

Apparently, it can be understood by those skilled in the art that, each of the modules and steps of the present disclosure can be realized with a general computing device. They can be centralized in one single computing device, or can be distributed in a network consisting of a plurality of computing devices. Optionally, they can be realized with program codes executable in computing devices, and can thus be stored in storage devices to be executed by the computing devices. Alternatively, they can be made into integrated circuit modules respectively, or a plurality of modules or steps of them can be made into one single integrated circuit module. In this manner, the present disclosure is not limited to any specific combination of hardware and software.

Although the embodiments disclosed by the present disclosure are described as above, the described contents are merely implementation modes employed for the purpose of facilitating the understanding of the present disclosure, and are not intended to limit the present disclosure. Any person skilled in the technical field of the present disclosure could make any modification and variation in the implementation forms and details, without departing from the spirit and scope of the present disclosure, but the patent protection scope of the present disclosure still needs to be based on the scope as defined in the appended claims.

The invention claimed is:

1. A driving method for reducing a residual image of AMOLED display, comprising steps of:

determining whether an image to be displayed is a static image;

performing hierarchical segmentation on the static image if a determination result is yes;

regulating an output brightness proportional coefficient of each pixel based on a hierarchical segmentation result; and outputting brightness of each pixel according to a corresponding output brightness proportional coefficient.

2. The method according to claim 1, wherein the step of performing hierarchical segmentation on the static image comprises:

determining a hierarchical point brightness of the hierarchical segmentation;

traversing each pixel in the static image, and classifying the pixel to a hierarchy closest the hierarchical point brightness;

calculating new hierarchical point brightness based on classified hierarchy; and repeating a process of traversing and classifying each pixel, and repeating a process of calculating new hierarchical point brightness until the hierarchical point brightness no longer changes.

3. The method according to claim 2, wherein the step of classifying the pixel to a hierarchy closest to the hierarchical point brightness comprises:

obtaining a pixel eigenvalue of each pixel;

calculating a difference between the pixel eigenvalue of a pixel and the hierarchical point brightness; and classifying the pixel to a hierarchy corresponding to a minimum absolute value of the difference.

4. The method according to claim 3, wherein the pixel eigenvalue comprises a maximum value of gray scale values of sub-pixels of the pixel or a brightness parameter obtained by calculation based on the gray scale values of the sub-pixels of the pixel.

5. The method according to claim 1, wherein the step of regulating an output brightness proportional coefficient of each pixel based on a hierarchical segmentation result comprises:

as to pixels with brightness belonging to different hierarchies, reducing brightness of a pixel belonging to a high hierarchy with a small output brightness proportional coefficient, while reducing brightness of a pixel belonging to a low hierarchy with a large output brightness proportional coefficient; and as to pixels with brightness belonging to a same hierarchy, reducing brightness of a pixel having high brightness with a small output brightness proportional coefficient, while reducing brightness of a pixel having low brightness with a large output brightness proportional coefficient.

6. The method according to claim 2, wherein the step of regulating an output brightness proportional coefficient of each pixel based on a hierarchical segmentation result comprises:

performing statistics on hierarchical point brightness of each hierarchy and a pixel area of each hierarchy;

determining a minimum output brightness proportional coefficient of each hierarchy based on the hierarchical point brightness of the hierarchy and the pixel area of the hierarchy; and determining an output brightness proportional coefficient of each pixel based on the minimum output brightness proportional coefficient of each hierarchy, the hierarchical point brightness of each hierarchy and brightness of the pixel itself.

7. The method according to claim 6, wherein the minimum output brightness proportional coefficient $M_k$ of each hierarchy is determined based on a following equation:

$$M_k = Y_k * S_k * m_k,$$

wherein $Y_k$ denotes hierarchical point brightness of each hierarchy; $S_k$ denotes a pixel area of each hierarchy; $m_k$ denotes a hierarchy brightness control coefficient; and k denotes a number of hierarchies.

8. The method according to claim 7, wherein when the static image is segmented into three hierarchies, an output brightness proportional coefficient of each pixel is determined based on a following equation:

$$c_1 = 1,\ y \leqslant \frac{Y_1 + Y_2}{2}$$

$$c_2 = 1 - (1 - M_2)\frac{2y - (Y_1 + Y_2)}{Y_3 - Y_1},\ \frac{Y_1 + Y_2}{2} < y \leqslant \frac{Y_2 + Y_3}{2}$$

$$c_3 = M_2 - (M_2 - M_3)\frac{y - \frac{Y_2 + Y_3}{2}}{255 - \frac{Y_2 + Y_3}{2}},\ y > \frac{Y_2 + Y_3}{2}$$

wherein $c_1$, $c_2$, $c_3$ respectively denote output brightness proportional coefficients of the hierarchies; $Y_1$, $Y_2$, $Y_3$ respectively denote hierarchical point brightness of each of the hierarchies; $M_1$, $M_2$, $M_3$ respectively denote minimum output brightness proportional coefficients of the hierarchies; and y denotes brightness of each pixel itself.

* * * * *